US009333744B2

(12) United States Patent
Morita et al.

(10) Patent No.: US 9,333,744 B2
(45) Date of Patent: May 10, 2016

(54) LIQUID EJECTION HEAD WITH A PLURALITY OF PRESSURE CHAMBERS AND METHOD FOR DRIVING LIQUID EJECTION HEAD AND SHRINK-DEFORMING THE PRESSURE CHAMBERS

(71) Applicant: CANON KABUSHIKI KAISHA, Tokyo (JP)

(72) Inventors: Hiromitsu Morita, Sakado (JP); Toru Nakakubo, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/486,893

(22) Filed: Sep. 15, 2014

(65) Prior Publication Data

US 2015/0077455 A1 Mar. 19, 2015

(30) Foreign Application Priority Data

Sep. 17, 2013 (JP) ..... 2013-191711

(51) Int. Cl.
*B41J 2/045* (2006.01)
*B41J 2/14* (2006.01)

(52) U.S. Cl.
CPC ..... *B41J 2/04581* (2013.01); *B41J 2/04573* (2013.01); *B41J 2/14209* (2013.01)

(58) Field of Classification Search
CPC ..... B41J 29/393; B41J 29/38; B41J 2/04525; B41J 2/04573; B41J 2/04581; B41J 2/14209
USPC ..... 347/14
See application file for complete search history.

(56) References Cited

U.S. PATENT DOCUMENTS 5,831,650 A * 11/1998 Reinten ..... B41J 2/04525 347/46
2008/0094446 A1* 4/2008 Sheahan ..... B41J 2/0451 347/40
2011/0205314 A1* 8/2011 Hibino ..... B41J 2/14233 347/71
2012/0019578 A1* 1/2012 Van Brocklin ..... B41J 2/04525 347/10
2012/0120138 A1* 5/2012 Banerjee ..... B41J 2/04525 347/10

FOREIGN PATENT DOCUMENTS

JP 2004-276273 A 10/2004

* cited by examiner

*Primary Examiner* — Alessandro Amari
*Assistant Examiner* — Michael Konczal
(74) *Attorney, Agent, or Firm* — Canon USA, Inc. IP Division

(57) ABSTRACT

A liquid ejection head, including: a plurality of ejection ports from which a liquid is ejected; a plurality of pressure chambers which communicate with the plurality of ejection ports and are constituted by piezoelectric portions that eject a liquid from the ejection ports by shrink-deforming; and a control unit configured to drive the piezoelectric portions so that the pressure chambers shrink-deform, wherein the control unit controls driving timing of the piezoelectric portions such that, after any of the plurality of pressure chambers is made to shrink-deform, a pressure chamber disposed not to adjoin the shrink-deformed pressure chamber is made to shrink-deform.

6 Claims, 15 Drawing Sheets

LIQUID EJECTION HEAD WITH A PLURALITY OF PRESSURE CHAMBERS AND METHOD FOR DRIVING LIQUID EJECTION HEAD AND SHRINK-DEFORMING THE PRESSURE CHAMBERS

BACKGROUND OF THE INVENTION

1. Field of the Invention

The present invention relates to a liquid ejection head provided with a plurality of pressure chambers including piezoelectric portions, and a method for driving the liquid ejection head.

2. Description of the Related Art

A liquid ejection head provided with a plurality of pressure chambers including piezoelectric portions has been known. When the pressure chambers are shrink-deformed, a liquid filling the pressure chambers is ejected from ejection ports.

In such a liquid ejection head as described above, it is known that vibration (i.e., residual vibration) is produced in the piezoelectric portions when the pressure chambers recover the state before the shrinkage deformation takes place. Japanese Patent Laid-Open No. 2004-276273 discloses a liquid ejection head which detects the residual vibration and determines whether an ejection state is normal or abnormal in accordance with a vibration pattern of the detected residual vibration.

In the liquid ejection head in which residual vibration is produced described above, in a case in which two adjoining pressure chambers shrink-deform sequentially, there is a possibility that vibration produced in the subsequently shrink-deformed pressure chamber is superimposed on residual vibration of the previously shrink-deformed pressure chamber. Such a situation may possibly cause various defects: for example, in the liquid ejection head described in Japanese Patent Laid-Open No. 2004-276273, there is a possibility that precise determination in the ejection state becomes difficult.

SUMMARY OF THE INVENTION

The present invention provides a liquid ejection head capable of making it difficult to superimpose other vibration on residual vibration produced in pressure chambers which include piezoelectric portions, and provides a method for driving the liquid ejection head.

According to the present invention, a liquid ejection head comprises: a plurality of ejection ports from which a liquid is ejected; a plurality of pressure chambers which communicate with the plurality of ejection ports and are constituted by piezoelectric portions that eject a liquid from the ejection ports by shrink-deforming; and a control unit configured to drive the piezoelectric portions so that the pressure chambers shrink-deform, wherein the control unit controls driving timing of the piezoelectric portions such that, after any of the plurality of pressure chambers is made to shrink-deform, a pressure chamber disposed not to adjoin the shrink-deformed pressure chamber is made to shrink-deform.

According to the present invention, a method for driving a liquid ejection head which includes a plurality of ejection ports, and a plurality of pressure chambers which communicate with the plurality of ejection ports and are filled with a liquid, each of the pressure chambers including a piezoelectric portion, and the liquid being ejected from each of the ejection ports by shrinkage deformation of each of the pressure chambers, the method comprising a driving step in which the piezoelectric portions are driven such that the pressure chambers are shrink-deformed to eject the liquid from the ejection ports, wherein, in the driving step, after any of the piezoelectric portions of the plurality of pressure chambers is driven, the piezoelectric portion of a pressure chamber disposed not to adjoin the pressure chamber is driven.

Further features of the present invention will become apparent from the following description of exemplary embodiments with reference to the attached drawings.

DESCRIPTION OF THE EMBODIMENTS

Hereinafter, embodiments of the present invention will be described with reference to the drawings.

First Embodiment

Figure 1:
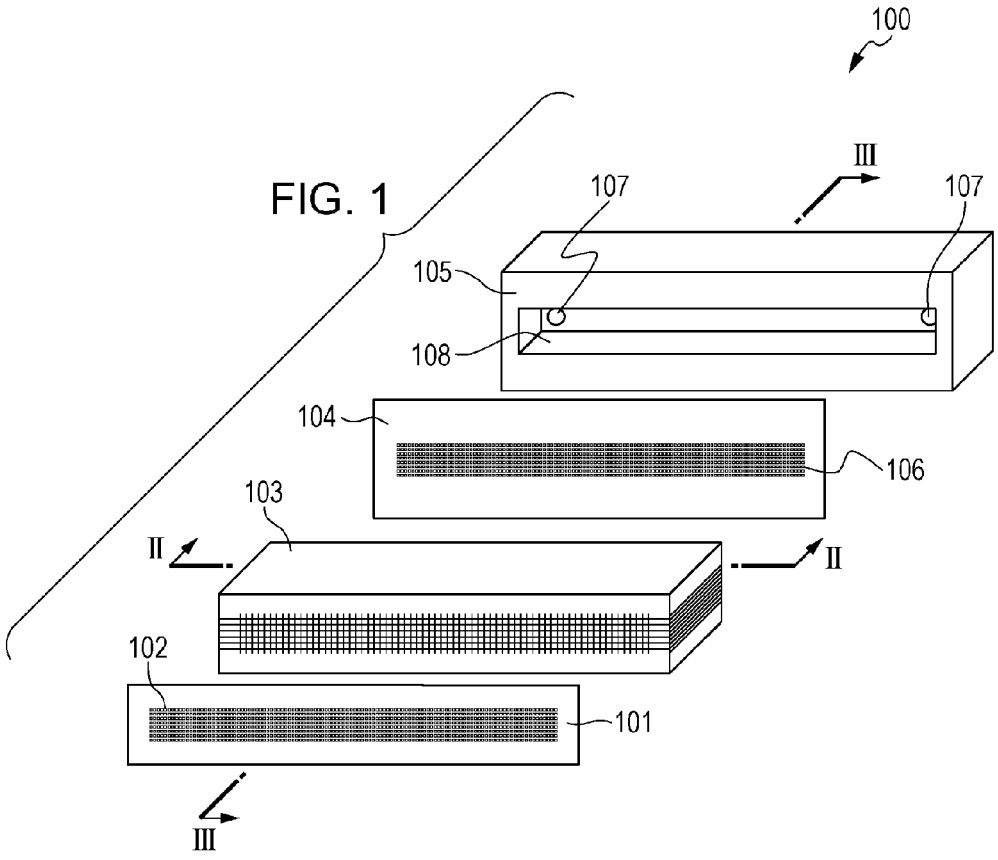
FIG. 1 is a perspective view of a liquid ejection head of a first embodiment.
Figure 2:
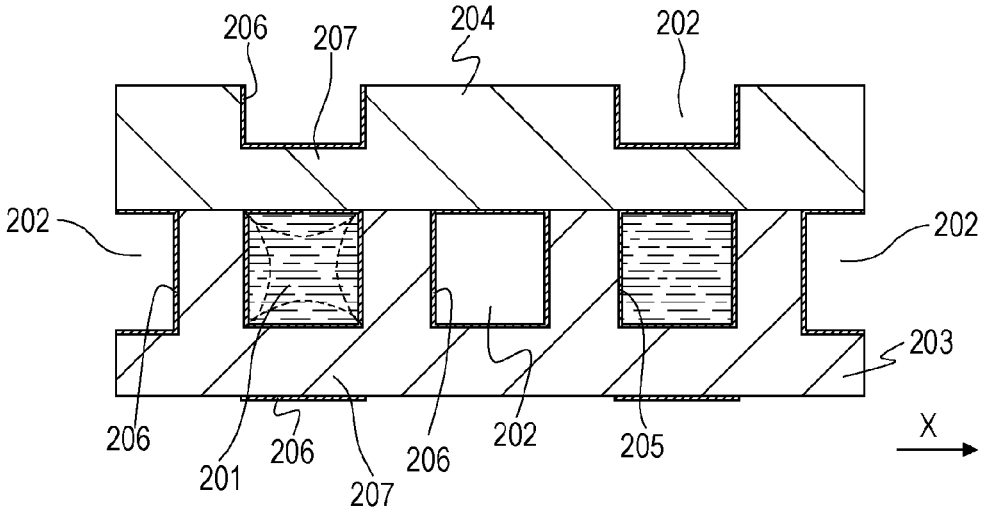
FIG. 2 is a partially enlarged cross-sectional view along line II-II of FIG. 1.

A first embodiment of the present invention will be described. FIG. 1 is an exploded perspective view of a liquid ejection head of the first embodiment. FIG. 2 is a partially enlarged cross-sectional view along line II-II of FIG. 1.

A liquid ejection head 100 illustrated in FIG. 1 includes an orifice plate 101 in which a plurality of ejection ports 102 are formed. Each of the ejection ports 102 is formed as a circular through hole. The orifice plate 101 is made of, for example, silicon or polyimide. A block body 103 is bonded to a rear surface of the orifice plate 101. As illustrated in FIG. 2, pressure chambers 201 and space portions 202 are formed in the block body 103. The pressure chambers 201 are filled with a liquid. The space portions 202 are not filled with a liquid.

As illustrated in FIG. 1, a plate member 104 is bonded to a rear surface of the block body 103. A plate member 105 is bonded to a rear surface of the plate member 104. Diaphragm holes 106 and driving circuits for each pressure chamber 201 are formed in the plate member 104. The diaphragm holes 106 are provided to prevent pressure of the pressure chambers 201 from escaping on the plate member 105 side. Ports 107 and a liquid chamber 108 communicating with the ports 107 are formed in the plate member 105.

In the liquid ejection head 100 of the present embodiment, a liquid is supplied to the liquid chamber 108 through the ports 107. The supplied liquid passes through the diaphragm holes 106 of the plate member 104 and fills the pressure chambers 201.

Hereinafter, the block body 103 will be described in detail with reference to FIG. 2. As illustrated in FIG. 2, the block body 103 of the present embodiment includes a first piezoelectric substrate 203 and a second piezoelectric substrate 204 laminated on the first piezoelectric substrate 203. A plurality of pressure chambers 201 and a plurality of space portions 202 are alternately arranged in a direction X (see FIG. 2) in the first piezoelectric substrate 203. The space portions 202 are arranged in the direction X in the second piezoelectric substrate 204.

A first electrode 205 is formed on an inner wall of the pressure chamber 201. A second electrode 206 is formed on an inner wall of the space portion 202. The first electrode 205 and the second electrode 206 constitute a pair of electrodes. In the present embodiment, piezoelectric portions 207 disposed between the first electrode 205 and the second electrode 206 constitute walls of the pressure chambers 201. In the present embodiment, the piezoelectric portions 207 adjoining in the direction X are separated by the space portions 202 and each pressure chamber 201 may shrink-deform individually.

In the present embodiment, 10 first piezoelectric substrates 203 and 10 second piezoelectric substrates 204 are laminated alternately. Therefore, a plurality of pressure chambers 201 are arranged in a grid pattern. This implements high recording density.

Figure 3:
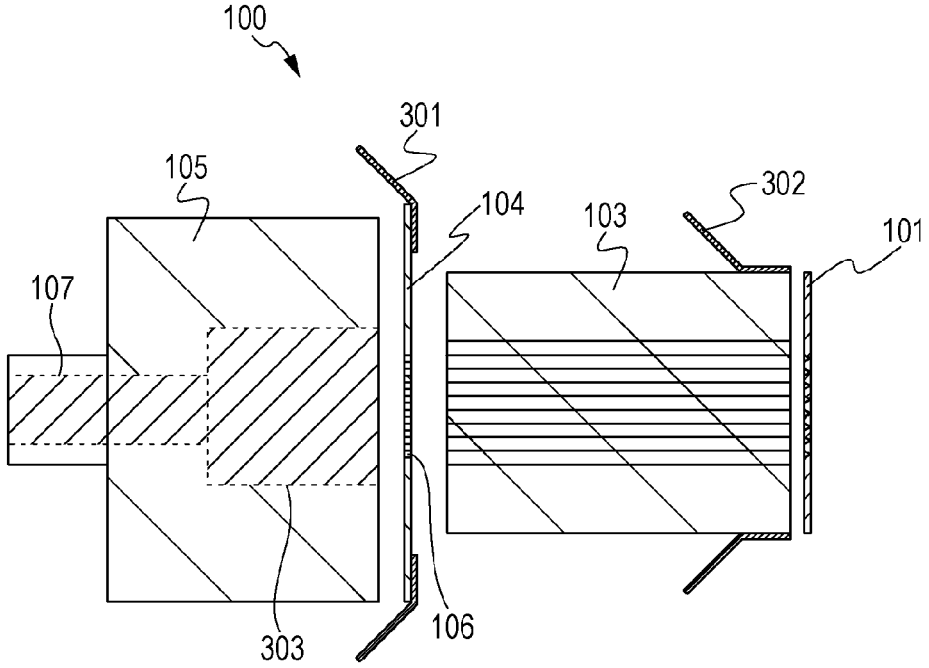
FIG. 3 is a cross-sectional view along line III-III of FIG. 1.

FIG. 3 is a cross-sectional view along line III-III of FIG. 1. As illustrated in FIG. 3, a first wiring cable 301 is attached to a front side of the plate member 104 (which is a bonding surface between the plate member 104 and the block body 103). The first wiring cable 301 is electrically connected to the first electrode 205. A second wiring cable 302 is attached to an upper surface and a lower surface of the block body 103. The second wiring cable 302 is electrically connected to the second electrode 206.

A voltage is applied, via the first wiring cable 301 and the second wiring cable 302, to between the first electrode 205 and the second electrode 206 from a recording device main body to which the liquid ejection head 100 of the present embodiment is attached. Then, the piezoelectric portions 207 disposed between the first electrodes 205 and the second electrodes 206 are driven to make the pressure chambers 201 shrink-deform (see an area illustrated by dotted lines in FIG. 2). By the shrinkage deformation, internal pressure of the pressure chambers 201 rises and the liquid is ejected from the ejection ports 102. Upon completion of application of the voltage to between the first electrodes 205 and the second electrodes 206, a driving state of the piezoelectric portions 207 is released and the pressure chambers 201 try to recover to the state before the shrinkage deformation takes place. At this time, residual vibration is produced in the piezoelectric portions 207.

Figure 4:
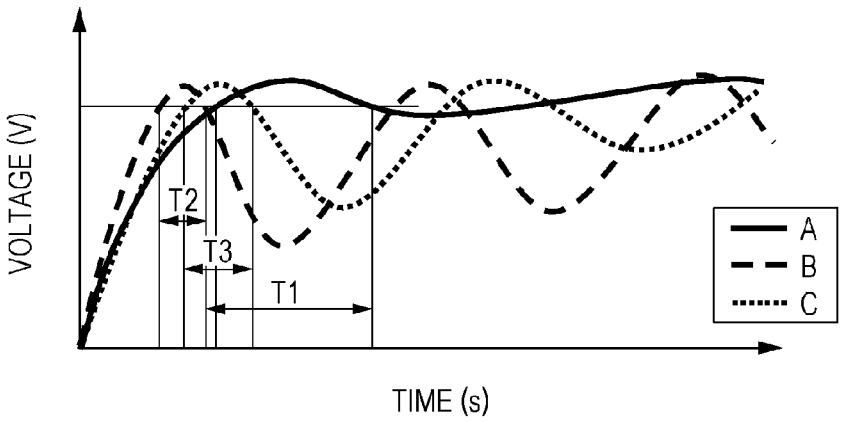
FIG. 4 is a waveform chart of residual vibration.

FIG. 4 is a waveform chart of the residual vibration. Hereinafter, the residual vibration will be described with reference to FIG. 4.

When an ejection state of the liquid is normal, the residual vibration is expressed as a waveform represented by line A. If air bubbles enter the pressure chambers 201, the amount of the liquid is reduced by the amount of the air bubbles, whereby the residual vibration is expressed as a waveform represented by line B. In a case in which the liquid adhering to edges of the ejection ports 102 dries, viscosity of the liquid increases and thus the residual vibration is expressed as a waveform represented by line C. As illustrated in FIG. 4, in a case in which the ejection state of the liquid is abnormal, cycles T2 and T3 of the residual vibration become shorter than a cycle T1 in a case in which the ejection state is normal. Therefore, if the residual vibration can be detected, it is possible to detect whether the ejection state is normal or abnormal.

Figure 5:
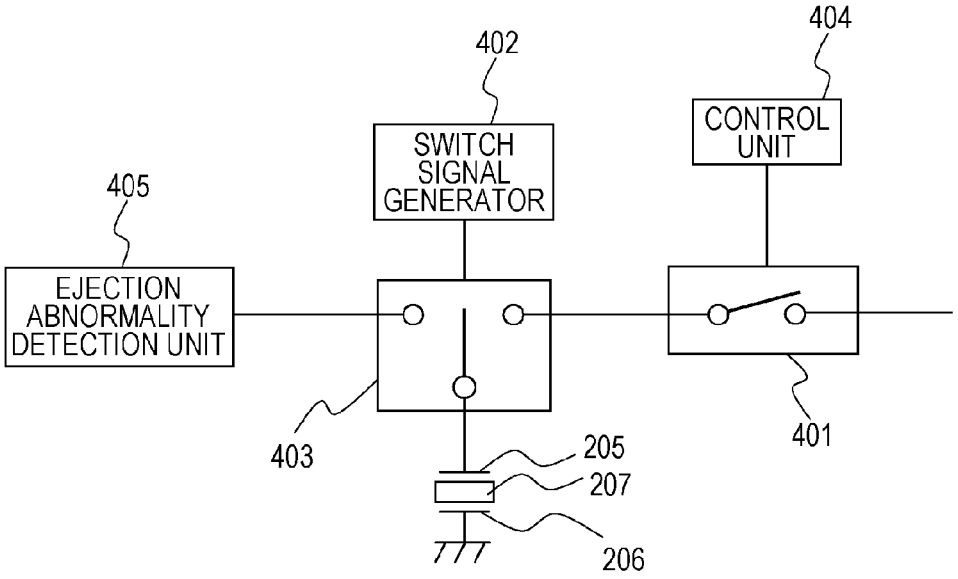
FIG. 5 is a diagram illustrating a circuit configuration for detecting residual vibration.

FIG. 5 is a diagram illustrating a circuit configuration for detecting residual vibration. When a control unit 404 turns a switch 401 (a first switch) ON, a high-level switch signal is input in a switch 403 (a second switch) from a switch signal generator 402. The switch 403 switches connection destination of the piezoelectric portion 207 to the switch 401 by inputting this switch signal. In this manner, a driving state of the piezoelectric portions 207 is maintained. When releasing this driving state, the control unit 404 turns the switch 401 OFF. Then, a low-level switch signal is input in the switch 403 from the switch signal generator 402. In accordance with the input of this switch signal, the switch 403 switches the connection destination of the piezoelectric portion 207 from the switch 401 to an ejection abnormality detection unit 405. Therefore, electrical vibration corresponding to the residual vibration produced in the piezoelectric portion 207 is input in the ejection abnormality detection unit 405.

Figure 6:
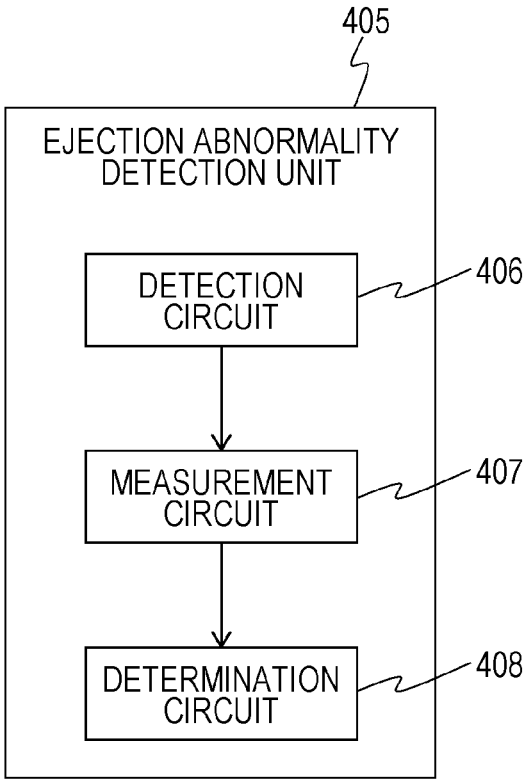
FIG. 6 is a block diagram illustrating an electrical configuration of an ejection abnormality detection unit.

FIG. 6 is a block diagram illustrating an electrical configuration of the ejection abnormality detection unit 405. The electrical vibration corresponding to the residual vibration is detected in a detection circuit 406. Then, a measurement circuit 407 measures a cycle of the residual vibration. Then, a determination circuit 408 compares the cycle of the residual vibration with a tolerance. In a case in which the cycle of the residual vibration is greater than the tolerance, the determination circuit 408 determines that the ejection state is normal. On the other hand, in a case in which the cycle of the residual vibration is smaller than the tolerance, the determination circuit 408 determines that the ejection state is abnormal.

Figure 7A:
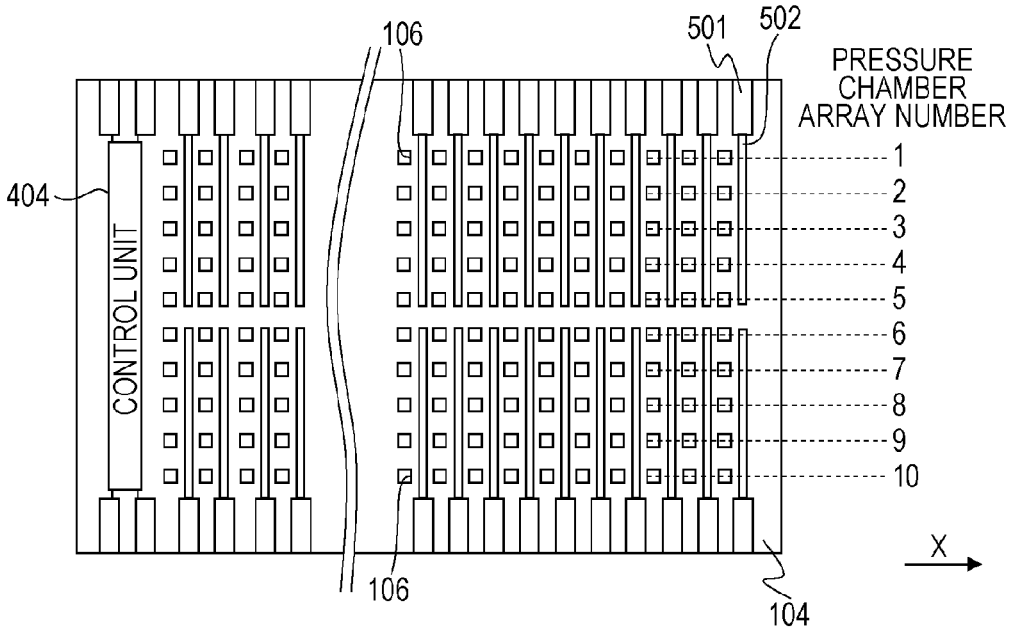
FIG. 7A is a plan view of a plate member seen from a bonding surface between the plate member and a block body.
Figure 7B:
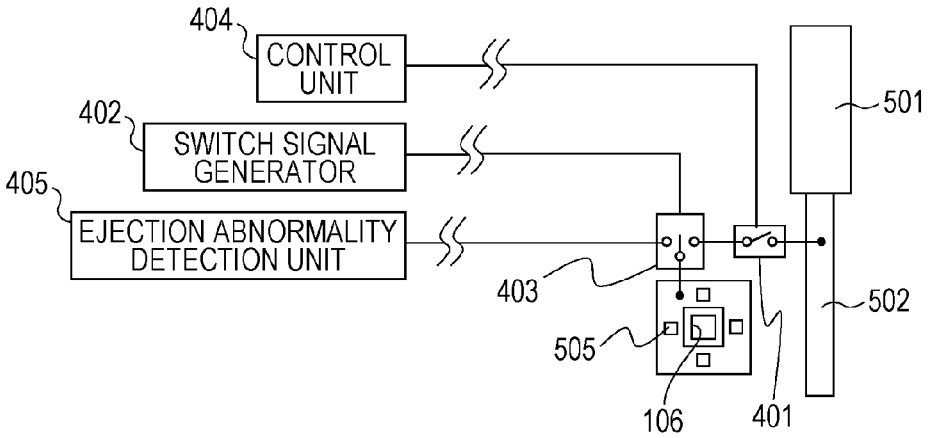
FIG. 7B is an enlarged view of FIG. 7A.

Hereinafter, a wiring configuration of the driving circuit of each pressure chamber 201 will be described. FIG. 7A is a plan view of a plate member 104 seen from a bonding surface between the plate member 104 and the block body 103. FIG. 7B is a partially enlarged view of FIG. 7A. FIG. 7A is a diagram which illustrates an area near the diaphragm holes 106 in a simplified manner and in which the switches 401 and 403, the switch signal generator 402, the ejection abnormality detection unit 405 and a bump 505 which are illustrated in FIG. 7B are not illustrated. The numbers from 1 to 10 provided on the right side of FIG. 7A represent the numbers of pressure chamber arrays to which the pressure chambers 201 communicating with the diaphragm hole 106 belong. The pressure chamber arrays 1 to 10 are constituted by a plurality of pressure chambers 201 arranged linearly in the direction X in the block body 103.

As illustrated in FIG. 7A, a plurality of connection terminals 501 are formed in a longitudinal direction (i.e., the direction X) of the plate member 104. Each connection terminal 501 is electrically connected to the first wiring cable 301 (see FIG. 3). As illustrated in FIG. 7B, the connection terminal 501 is connected to the switch 401 via wiring 502. The switch 401 is connected to the bump 505 via the switch 403. The bump 505 is connected to the first electrode 205. The driving circuit including the wiring 502, the switch 503 and the like is formed by forming a transistor on a silicon substrate, and then forming a plurality of laminates of insulating film and wiring thereon. Wiring between the layers are connected by via holes. In the present embodiment, with the configuration in which a plurality of connection terminals 401 are arranged in the longitudinal direction of the plate members 104, the wiring may be provided widely and thickly to prevent a voltage drop. Therefore, the length of the wiring in the circuit can be shortened compared with a configuration in which the connection terminals 501 are arranged in the width direction of the plate members 104.

Figure 8:
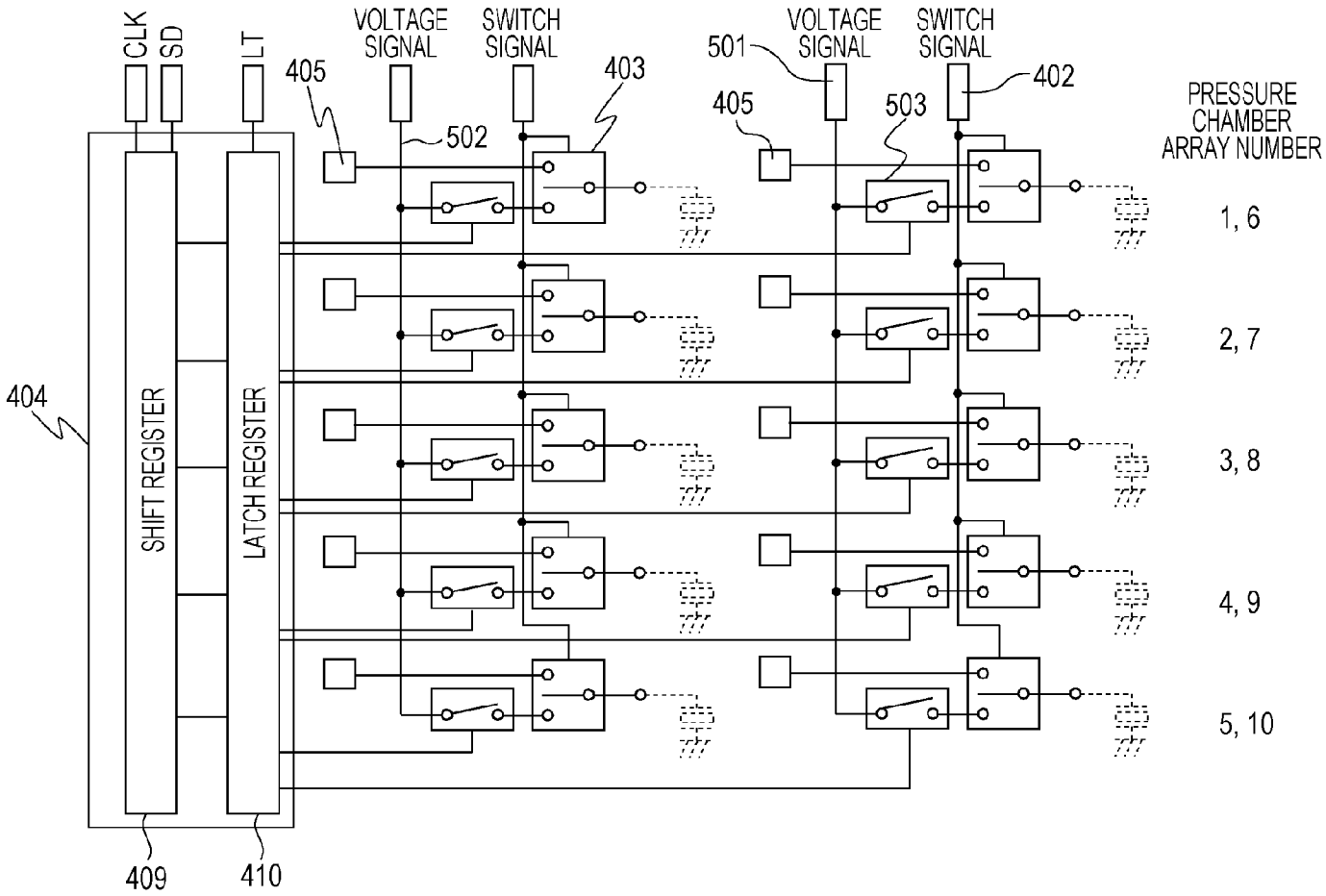
FIG. 8 is a diagram illustrating a driving circuit of pressure chambers.
Figure 9:
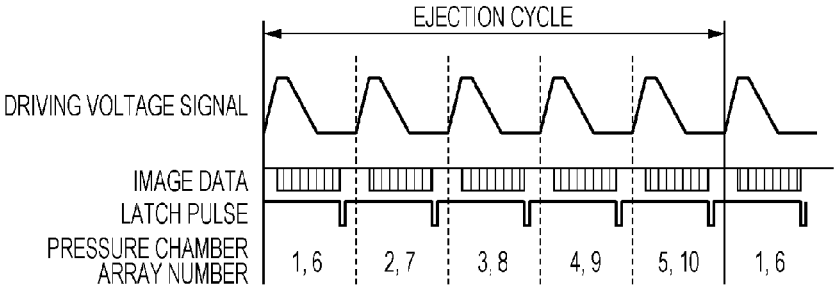
FIG. 9 is a timing chart illustrating transmission timing of image data.

Hereinafter, a circuit configuration for driving the pressure chambers 201 in accordance with image data will be described. FIG. 8 is a diagram illustrating a driving circuit of the pressure chambers 201. FIG. 9 is a timing chart illustrating transmission timing of image data.

In the present embodiment, in order to reduce the number of signal lines, the image data is previously converted into control signals for serial transmission (SD) in the recording device main body. The control signals are input in the control unit 404 in synchronization with transfer clocks (CLK). A shift register 409 and a latch register 410 are provided in the control unit 404. Although only one shift register 409 and one latch register 410 are illustrated in FIG. 8, the same number of registers as that of the ejection ports 102 (i.e., the pressure chambers 201) are provided.

The control signals input in the control unit 404 are converted into control signals for parallel transmission by the shift register 409. The converted control signals are retained in the latch register 410 by latch pulses (LT). Then, in accordance with the control signals output from the latch register 410, the switch 503 is turned to an ON state or an OFF state.

When the switch 503 is turned to the ON state, the switch 403 connects the piezoelectric portions 207 to the switch 401. Then the piezoelectric portions 207 are driven and the pressure chambers 201 are shrink-deformed. Then the liquid is ejected from the ejection ports 102.

On completion of driving of the piezoelectric portions 207, the switch 503 is turned to the OFF state. When the switch 503 is turned to the OFF state, the switch 403 connects the piezoelectric portion 207 to the ejection abnormality detection unit 405. Thereby, the residual vibration is detected by the ejection abnormality detection unit 405.

In the present embodiment, although the driving circuit is formed on the bonding surface of the plate member 4 with the block body 103, the driving circuit may be formed on the bonding surface of the orifice plate 101 with the block body 103.

Figure 10:
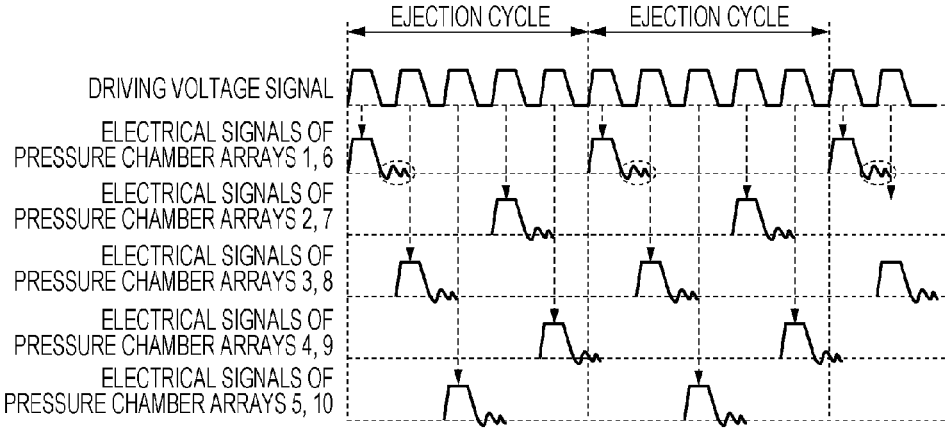
FIG. 10 is a timing chart illustrating driving timing of pressure chamber arrays.

Hereinafter, the driving timing of the pressure chamber arrays 1 to 10 will be described. FIG. 10 is a timing chart illustrating the driving timing of the pressure chamber arrays 1 to 10.

In the present embodiment, the pressure chamber arrays 1 to 10 are divided into a group consisting of the pressure chamber arrays 1 to 5 and a group consisting of the pressure chamber arrays 6 to 10. The pressure chamber arrays belonging to each group are driven at different timings of an ejection cycle. In the present embodiment, the pressure chamber array 1 and the pressure chamber array 6 are driven at the same time. Similarly, the pressure chamber arrays 2 and 7, the pressure chamber arrays 3 and 8, the pressure chamber arrays 4 and 9, and the pressure chamber arrays 5 and 10 are driven at the same time, respectively.

As illustrated in FIG. 10, in the present embodiment, the pressure chambers 201 belonging to the pressure chamber arrays which do not adjoin those pressure chamber arrays shrink-deform at the next timing of the timing at which the pressure chambers 201 belonging to any of the pressure chamber arrays 1 to 5 (or the pressure chamber arrays 6 to 10) shrink-deformed. Specifically, the control unit 404 causes the pressure chambers 201 belonging to the pressure chamber array 3 to shrink-deform at the next timing of the timing at which the pressure chambers 201 belonging to the pressure chamber array 1 shrink-deformed. At the next timing, the control unit 404 causes the pressure chambers 201 belonging to the pressure chamber array 5 to shrink-deform. Then, the control unit 404 causes the pressure chambers 201 belonging to the pressure chamber array 2, the pressure chamber array 4 and the pressure chamber array 1 to sequentially shrink-deform.

With the control operation of the control unit 404 described above, the pressure chambers 201 belonging to the pressure chamber array 2 adjoining the pressure chamber array 1 do not shrink-deform at the timing at which the residual vibration of the pressure chambers 201 belonging to the pressure chamber array 1 is produced (i.e., portions enclosed by dotted lines in FIG. 10). Therefore, a situation in which vibration produced in the subsequently shrink-deformed pressure chambers is superimposed on the residual vibration produced in the previously shrink-deformed pressure chambers may be avoided. Thereby, it is possible that the ejection abnormality detection unit 405 correctly detects the residual vibration and detects abnormality in the ejection state with high accuracy.

Figure 11:
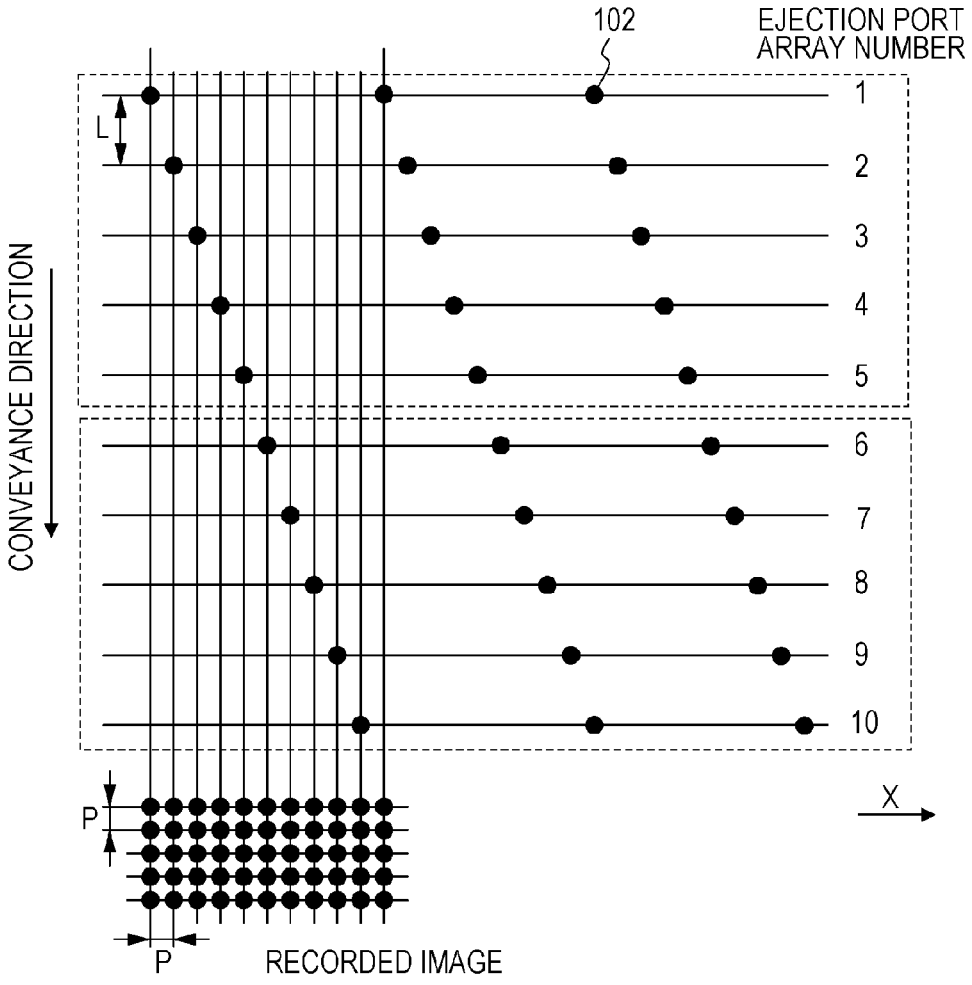
FIG. 11 is a diagram illustrating an arrangement layout of ejection ports.

Hereinafter, an arrangement configuration of the ejection ports 102 from which the liquid is ejected at ejection timing corresponding to the driving timing of each pressure chamber described above will be described. FIG. 11 is a diagram illustrating an arrangement layout of ejection ports 102. The numbers provided on the right side of FIG. 11 represent the numbers of ejection port arrays. The numbers of the ejection port arrays correspond to the numbers of the pressure chamber arrays. As described above, the pressure chamber arrays 1 to 10 are divided into two groups each consisting of five lines, and each being electrically driven independently. Hereinafter, an arrangement configuration of the ejection port arrays 1 to 5 corresponding to the pressure chamber arrays 1 to 5 will be described.

In the present embodiment, as illustrated in FIG. 11, the ejection port arrays 1 to 5 are disposed at positions shifted by pitch P from one another in the direction X. In the present embodiment, the ejection cycle is equally divided into five and the pressure chambers 201 belonging to the pressure chamber array 1, the pressure chamber array 3, the pressure chamber array 5, the pressure chamber array 4, and the pressure chamber array 2 are driven in this order with a time delay by a 1/5 cycle (see FIG. 10). Then the liquid is ejected from the ejection ports 102 belonging to the ejection port array 1, the ejection port array 3, the ejection port array 5, the ejection port array 4, and the ejection port array 2 in this order with a time delay by a 1/5 cycle. At this time, a recording medium is conveyed in a conveyance direction which crosses perpendicularly the direction X (see FIG. 12). A distance L between ejection port arrays is defined by P×(3/5). For example, in a case in which the pitch P (i.e., the distance between recording dots) is 600 dot per inch (dpi), the distance L is defined by 42.3×(3/5) μm.

By defining the distance L in this way, it becomes possible to record the recording dots without positional displacement in the conveyance direction (see FIG. 11).

Note that the distance L may be suitably changed depending on the number of the pressure chamber arrays belonging to a single group. For example, in a case in which the pressure chamber arrays of seven lines belong to a single group and the ejection cycle is equally divided into seven, the distance L is defined as P×(4/7). The distance L may be an integral multiple of the pitch P of a recording dot grid.

COMPARATIVE EXAMPLE

Hereinafter, a liquid ejection head of Comparative Example will be described. The liquid ejection head of Comparative Example differs from the liquid ejection head 100 of the first embodiment in the method for driving each pressure chamber array. Hereinafter, the difference from the liquid ejection head 100 of the first embodiment will be described mainly.

Figure 12:
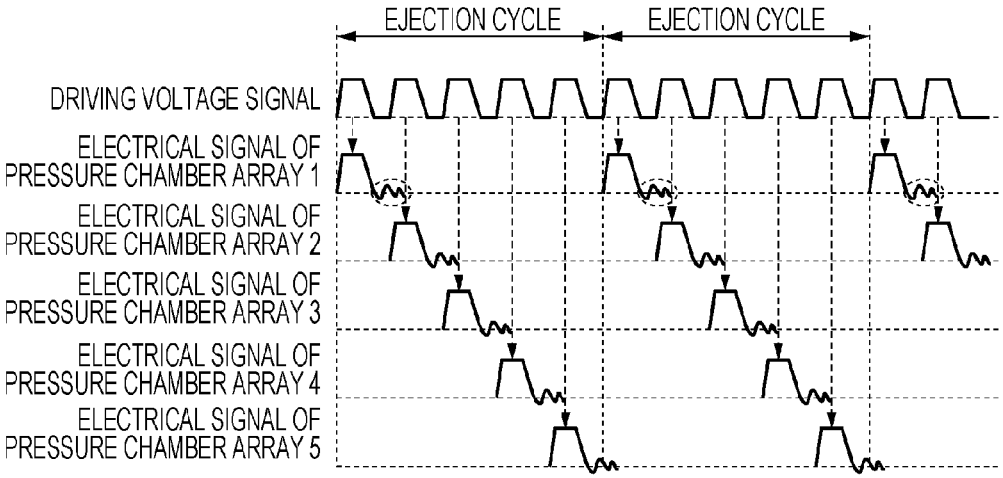
FIG. 12 is a timing chart illustrating driving timing of pressure chamber arrays of Comparative Example.

FIG. 12 is a timing chart illustrating driving timing of pressure chamber arrays 1 to 5 of Comparative Example. As illustrated in FIG. 12, when the pressure chamber array 1 is driven, the pressure chamber array 2 adjoining the pressure chamber array 1 is driven at the next timing. Then the pressure chambers belonging to the pressure chamber array 3, the pressure chamber array 4, and the pressure chamber array 5 are driven in this order.

In the driving form of the pressure chambers described above, for example, the timings at which the residual vibration of the pressure chambers belonging to the pressure chamber array 1 is produced (portions enclosed by dotted lines in FIG. 12) are superimposed on the driving timings of the pressure chambers belonging to the pressure chamber array 2. Thus, there is a possibility that vibration produced at the time of driving the subsequently shrink-deformed pressure chambers is superimposed on residual vibration of the previously shrink-deformed pressure chambers. Therefore, correct detection of the residual vibration becomes difficult and detection of abnormality in the ejection state with high accuracy becomes difficult.

In the liquid ejection head 100 of the present embodiment, as described above, the control unit 404 controls the driving timing of the pressure chambers 201 so that the pressure chambers adjoining each other are not driven sequentially. Thereby, it is possible that the ejection abnormality detection unit 405 correctly detects the residual vibration and detects abnormality in the ejection state with high accuracy.

In the present embodiment, in a case in which a certain number or more of the ejection abnormality detection units 405 detect abnormality in the ejection state, a recovery means (not illustrated) provided at a position facing the ejection ports 102 performs a recovery action. Therefore, it is not necessary to provide each ejection abnormality detection unit 405 with respect to each pressure chamber 201 (i.e., each ejection port 102). For example, a single ejection abnormality detection unit 405 may be provided with respect to a plurality of pressure chambers 201 arranged linearly in the laminated direction which crosses perpendicularly the direction X. In a case in which each pressure chamber 201 is driven in accordance with the timing chart of FIG. 10, regarding the five pressure chambers 201 arranged in the laminated direction, the timings at which the residual vibration is produced are not superimposed on one another. Therefore, even in a configuration in which the residual vibration of these pressure chambers 201 is detected by a single ejection abnormality detection unit 405, ejection abnormality may be detected with high accuracy. Further, since the number of wiring and parts of the circuit is decreased, reduction in size of the liquid ejection head may be achieved.

Second Embodiment

A second embodiment of the present invention will be described. Hereinafter, differences from the first embodiment will be described mainly.

Figure 13:
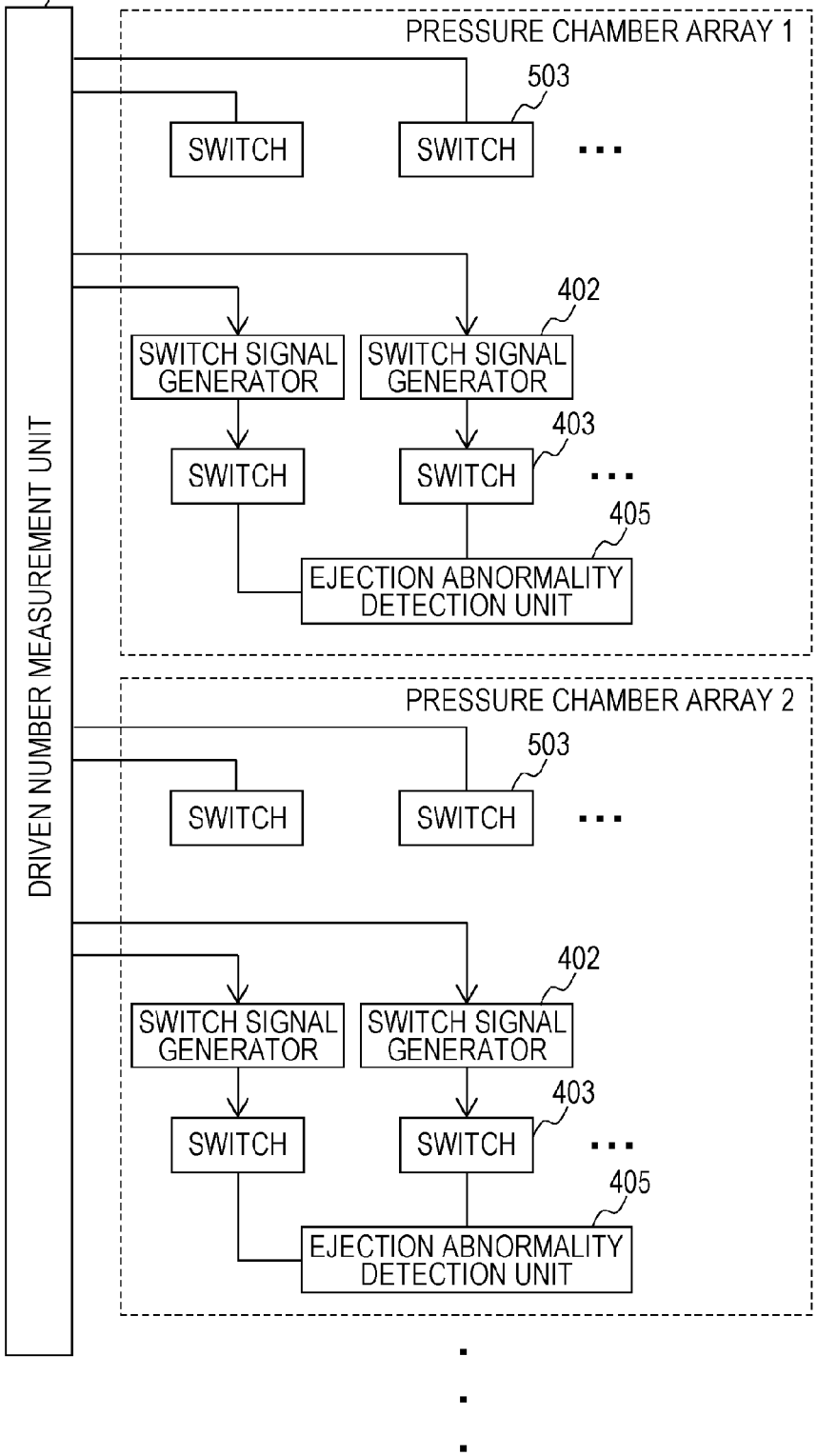
FIG. 13 is a block diagram illustrating an electrical main part configuration of a liquid ejection head of a second embodiment.

FIG. 13 is a block diagram illustrating an electrical main part configuration of a liquid ejection head of a second embodiment. In FIG. 13, components similar to those of the liquid ejection head 100 of the first embodiment are denoted by the same reference numerals and detailed description thereof will be omitted.

As illustrated in FIG. 13, the liquid ejection head of the present embodiment differs from the liquid ejection head 100 of first embodiment in that a single ejection abnormality detection unit 405 is provided with respect to a single pressure chamber array, and that a driven number measurement unit 601 is provided additionally.

In the liquid ejection head of the present embodiment, in a case in which a plurality of pressure chambers 201 belonging to a single pressure chamber array shrink-deform at the same timing, a plurality of residual vibrations are detected simultaneously by a single ejection abnormality detection unit 405. At this time, in a case in which the amount of the residual vibration representing a normal ejection state (see line A of FIG. 4) is very small, the detected residual vibration forms substantially the same vibration pattern as the residual vibration representing an abnormal ejection state (see lines B and C of FIG. 4). Therefore, a possibility that abnormality in the ejection state is overlooked is very low.

On the contrary, in a case in which the amount of the residual vibration representing a normal ejection state is very large, even if a component of the residual vibration representing an abnormal ejection state is included in the detected residual vibration, the detected residual vibration forms substantially the same vibration pattern as the residual vibration representing the normal ejection state. In order not to overlook abnormality in the ejection state, it is desirable to detect the residual vibration when the number of the pressure chambers 201 being driven at the same timing in a single pressure chamber array is small. For this reason, the driven number measurement unit 601 is provided in the liquid ejection head of the present embodiment.

The driven number measurement unit 601 measures the number of the pressure chambers 201 which are shrink-deformed in accordance with the state of switches 503. In a case in which the switch 503 is an ON state, a voltage is applied to between a first electrode 205 and a second electrode 206 and a piezoelectric portion 207 disposed between these electrodes causes the pressure chamber 201 to shrink-deform. Therefore, the driven number measurement unit 601 grasps the number of shrink-deformed pressure chambers 201 for every pressure chamber array by counting the number of switches 503 in the ON state.

In a case in which the number of the pressure chambers 201 shrink-deforming at the same timing in a single pressure chamber array becomes equal to or smaller than a threshold value, the driven number measurement unit 601 sends a specific signal to the switch signal generator 402. By the input of this signal, the signal generator 402 inputs a low-level switch signal in a switch 403 in cooperation with the switch 503. That is, the driven number measurement unit 601 permits execution of a switching action of the switch 403.

In the present embodiment, accuracy in abnormality detection of the ejection state may be secured by setting the threshold value to as small a value as possible so that abnormality in the ejection state is not overlooked. Although the threshold value is desirably 1, the threshold value may be greater than 1 so long as abnormality in the ejection state is not overlooked.

Third Embodiment

A third embodiment of the present invention will be described. Hereinafter, differences from the first embodiment will be described mainly.

Figure 14:
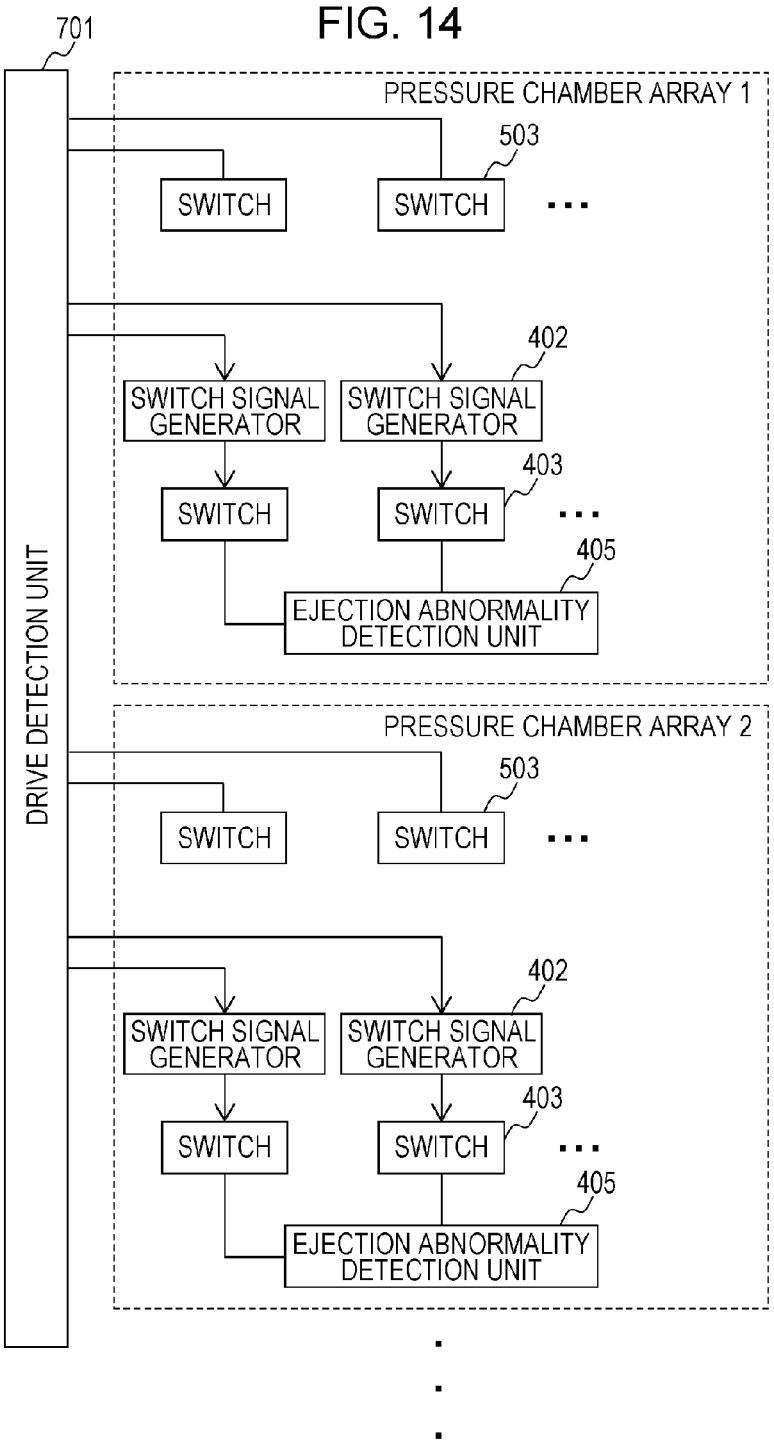
FIG. 14 is a block diagram illustrating an electrical main part configuration of a liquid ejection head of a third embodiment.

FIG. 14 is a block diagram illustrating an electrical main part configuration of a liquid ejection head of a third embodiment. In FIG. 14, components similar to those of the liquid ejection head 100 of the first embodiment are denoted by the same reference numerals and detailed description thereof will be omitted.

The liquid ejection head of the present embodiment differs from the liquid ejection head 100 of first embodiment in that a single ejection abnormality detection unit 405 is provided with respect to a single pressure chamber array, and that a driving detection unit 701 is provided additionally.

For example, if two adjoining pressure chambers in a single pressure chamber array are driven at the same time, vibration produced during the shrinkage deformation of one of the pressure chambers may be transmitted to the other of the pressure chambers. In this case, a voltage higher than a voltage of a driving voltage signal is applied to the piezoelectric portion 207. In such a state, residual vibration detected by the ejection abnormality detection unit 405 may be varied. Then, in order to reduce variation in the residual vibration, the driving detection unit 701 is provided in the liquid ejection head of the present embodiment.

The driving detection unit 701 grasps the shrink-deformed pressure chambers 201 for every pressure chamber array by detecting the ON state of the switch 503 in the same manner as the driven number measurement unit 601 described in the second embodiment.

In a case in which a plurality of pressure chambers 201 disposed at positions not adjoining one another in a single pressure chamber array shrink-deform at the same time, the driving detection unit 701 sends a specific signal to the switch signal generator 402. By the input of this specific signal, the signal generator 402 inputs a low-level switch signal in a switch 403. That is, the driving detection unit 701 permits execution of a switching action of the switch 403.

In the present embodiment, the ejection abnormality detection unit 405 detects residual vibration at the timing at which the adjoining pressure chambers in a single pressure chamber array do not shrink-deform. This further increases the accuracy in abnormality detection of the ejection state.

In the first to third embodiments described above, a plurality of pressure chambers 201 are formed in the block body 103 that is a laminate in which the first piezoelectric substrates 203 and the second piezoelectric substrates 204 are laminated alternately. In the present invention, however, a member in which a plurality of pressure chambers 201 are formed is not limited to the block body 103. Hereinafter, liquid ejection heads having different structures from that of the block body 103 will be described with reference to fourth to sixth embodiments. In the fourth to sixth embodiments, components similar to those of the liquid ejection head 100 of the first embodiment are denoted by the same reference numerals and detailed description thereof will be omitted.

Fourth Embodiment

Figure 15:
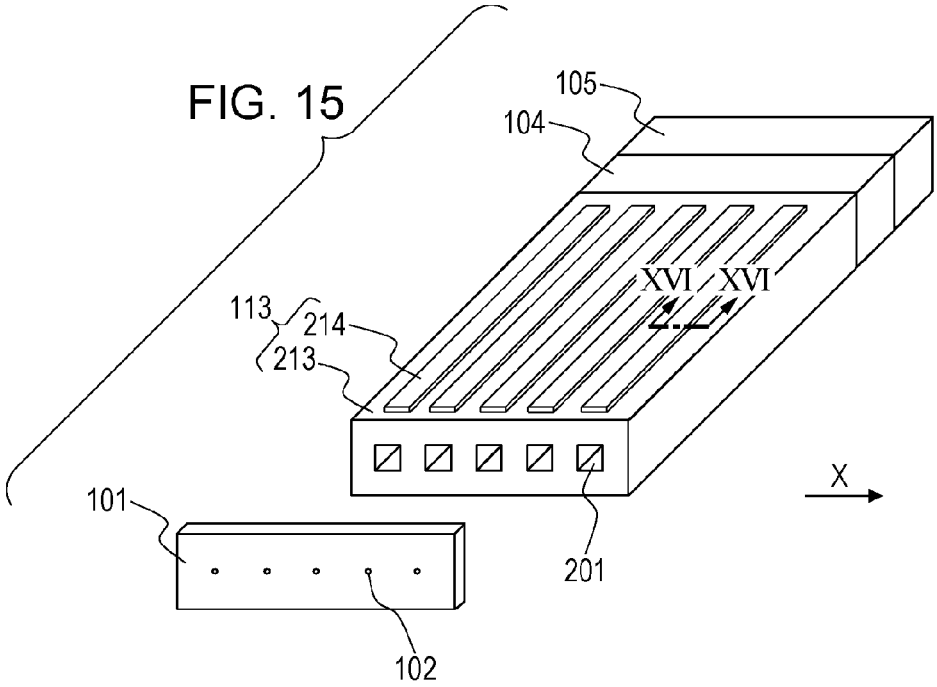
FIG. 15 is an exploded perspective view illustrating a main part configuration of a liquid ejection head of a fourth embodiment.

FIG. 15 is an exploded perspective view illustrating a main part configuration of a liquid ejection head of a fourth embodiment.

The block body 113 of the present embodiment is formed by a laminate in which a non-piezoelectric substrate 213 is laminated. FIG. 15 illustrates a sheet of non-piezoelectric substrate 213. A plurality of pressure chambers 201 are arranged in the non-piezoelectric substrate 213 in the direction X. A piezoelectric substrate 214 is bonded to an outer surface of a wall of each pressure chamber 201.

The non-piezoelectric substrate 213 may be made of ceramic, metal and the like. From the viewpoint of heat deformation in a state in which the non-piezoelectric substrate 213 is bonded to the piezoelectric substrate 214, ceramic having substantially the same coefficient of thermal expansion as that of the piezoelectric substrate 214 is desirably used.

Figure 16:
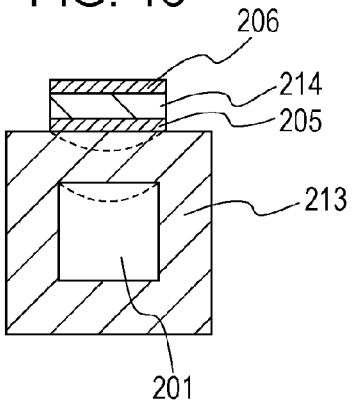
FIG. 16 is a cross-sectional view along line XVI-XVI of FIG. 15.

FIG. 16 is a cross-sectional view along line XVI-XVI of FIG. 15. As illustrated in FIG. 16, the piezoelectric substrate 214 is disposed between a first electrode 205 and a second electrode 206. The piezoelectric substrate 214 corresponds to the piezoelectric portion 207 of the first embodiment. Therefore, when a voltage is applied to between the first electrode 205 and the second electrode 206, the piezoelectric substrate 214 causes the pressure chamber 201 to shrink-deform (see a portion illustrated by dotted lines in FIG. 16).

Fifth Embodiment

Figure 17:
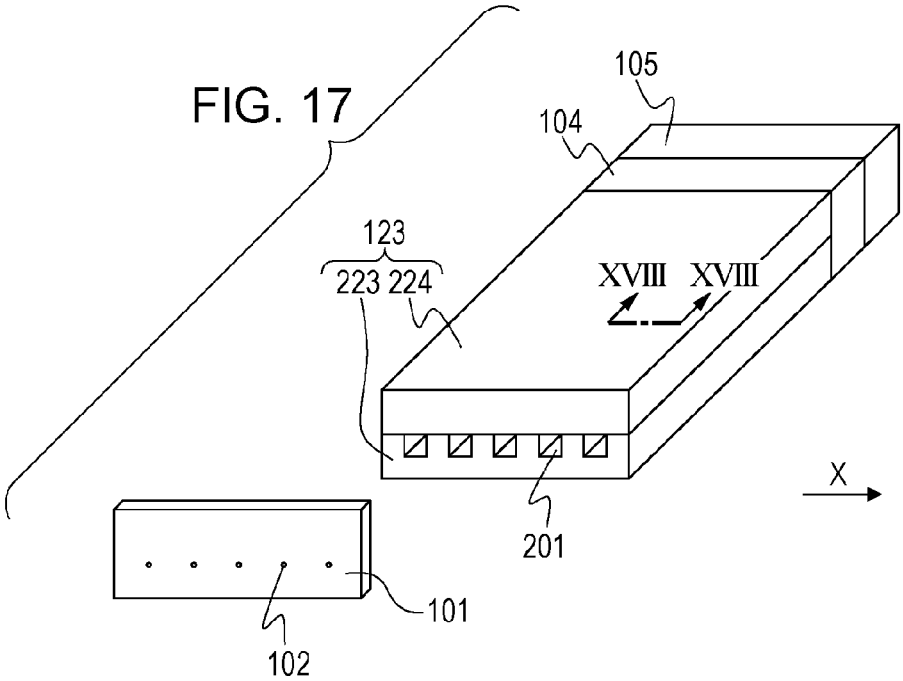
FIG. 17 is an exploded perspective view illustrating a main part configuration of a liquid ejection head of a fifth embodiment.

FIG. 17 is an exploded perspective view illustrating a main part configuration of a liquid ejection head of a fifth embodiment.

The block body 123 of the present embodiment is formed by a laminate in which a non-piezoelectric substrate 223 and a piezoelectric substrate 224 are laminated alternately. FIG. 17 illustrates a laminate of the non-piezoelectric member 223 and the piezoelectric substrate 224. A plurality of pressure chambers 201 are arranged in the non-piezoelectric substrate 223 in the direction X.

The non-piezoelectric substrate 223 may be made of ceramic, metal and the like. From the viewpoint of heat deformation in a state in which the non-piezoelectric substrate 223 is bonded to the piezoelectric substrate 224, ceramic having substantially the same coefficient of thermal expansion as that of the piezoelectric substrate 224 is desirably used.

Figure 18:
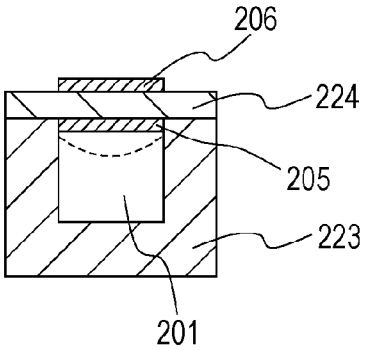
FIG. 18 is a cross-sectional view along line XVIII-XVIII of FIG. 17.

FIG. 18 is a cross-sectional view along line XVIII-XVIII of FIG. 17. As illustrated in FIG. 18, a portion of the piezoelectric substrate 224 forming a wall of the pressure chamber 201 is disposed between a first electrode 205 and a second electrode 206. The portion disposed between the electrodes corresponds to the piezoelectric portion 207 of the first embodiment. Therefore, when a voltage is applied to between the first electrode 205 and the second electrode 206, the piezoelectric substrate 224 causes the pressure chamber 201 to shrink-deform (see a portion illustrated by dotted lines in FIG. 18).

Sixth Embodiment

Figure 19:
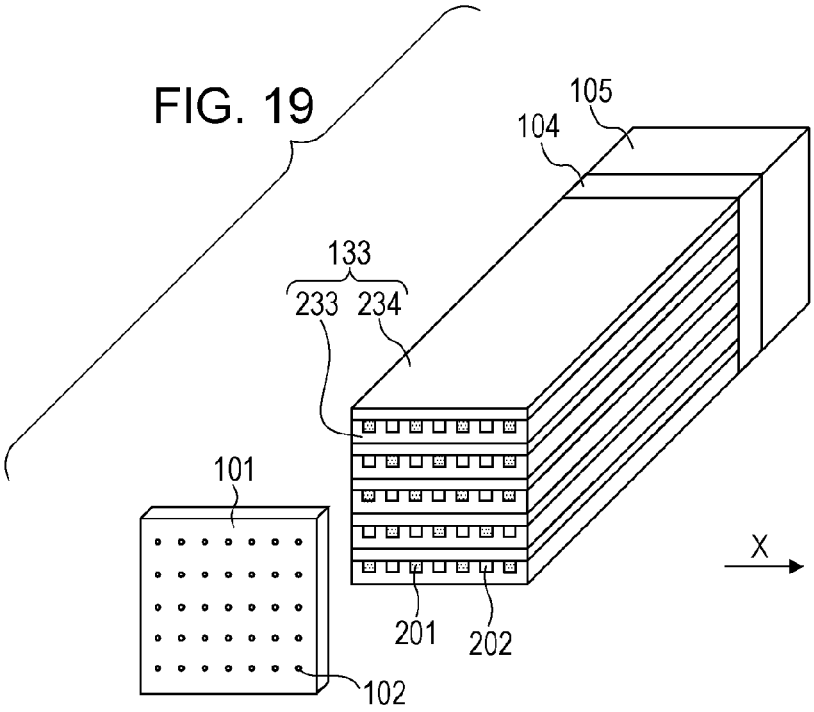
FIG. 19 is an exploded perspective view of a liquid ejection head of a sixth embodiment.
Figure 20:
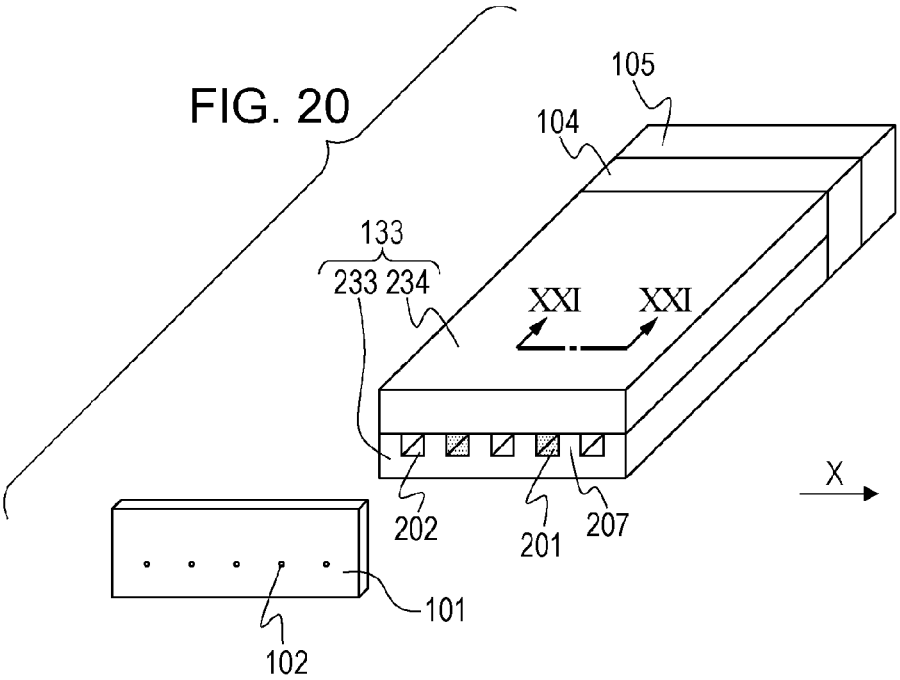
FIG. 20 is a partial exploded perspective view of the liquid ejection head illustrated in FIG. 19.

FIG. 19 is an exploded perspective view of a liquid ejection head of a sixth embodiment. FIG. 20 is a partial exploded perspective view of the liquid ejection head illustrated in FIG. 19.

The block body 133 of the present embodiment is formed by a laminate in which a piezoelectric substrate 233 and a top plate 234 are laminated alternately. The piezoelectric substrate 233 and the top plate 234 are bonded to each other via an adhesive. The piezoelectric substrate 233 is desirably made of, for example, lead zirconate titanate. The top plate 234 may be made of ceramic, metal and the like. From the viewpoint of heat deformation in a state in which the top plate 234 is bonded to the piezoelectric substrate 233, ceramic having substantially the same coefficient of thermal expansion as that of the piezoelectric substrate 233 is desirably used.

In the piezoelectric substrate 233, a plurality of recessed grooves are formed in the direction X at predetermined intervals. Each groove forms a pressure chamber 201 and a space portion 202. The pressure chamber 201 and the space portion 202 are arranged alternately in the direction X.

Figure 21:
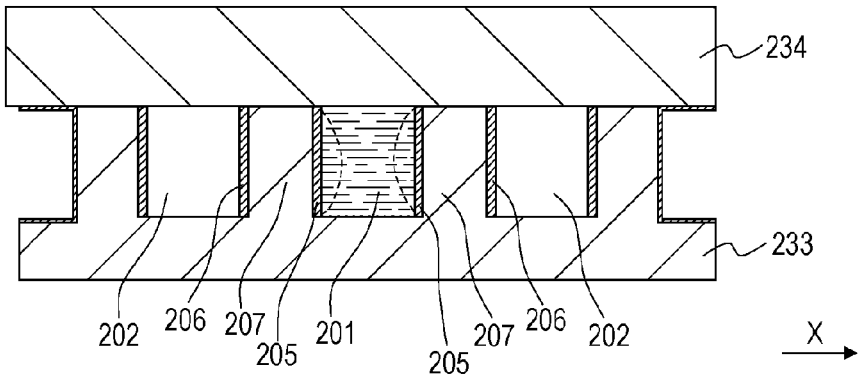
FIG. 21 is a cross-sectional view along line XXI-XXI of FIG. 20.

FIG. 21 is a cross-sectional view along line XXI-XXI of FIG. 20. As illustrated in FIG. 21, a first electrode 205 is formed on a side wall of the pressure chamber 201. A second electrode 206 is formed on a side wall of the space portion 202. When a voltage is applied to between the first electrode 205 and the second electrode 206, the piezoelectric portion 207 disposed between these electrodes causes the pressure chamber 201 to shrink-deform (see the portion illustrated by dotted lines in FIG. 21).

Figure 22:
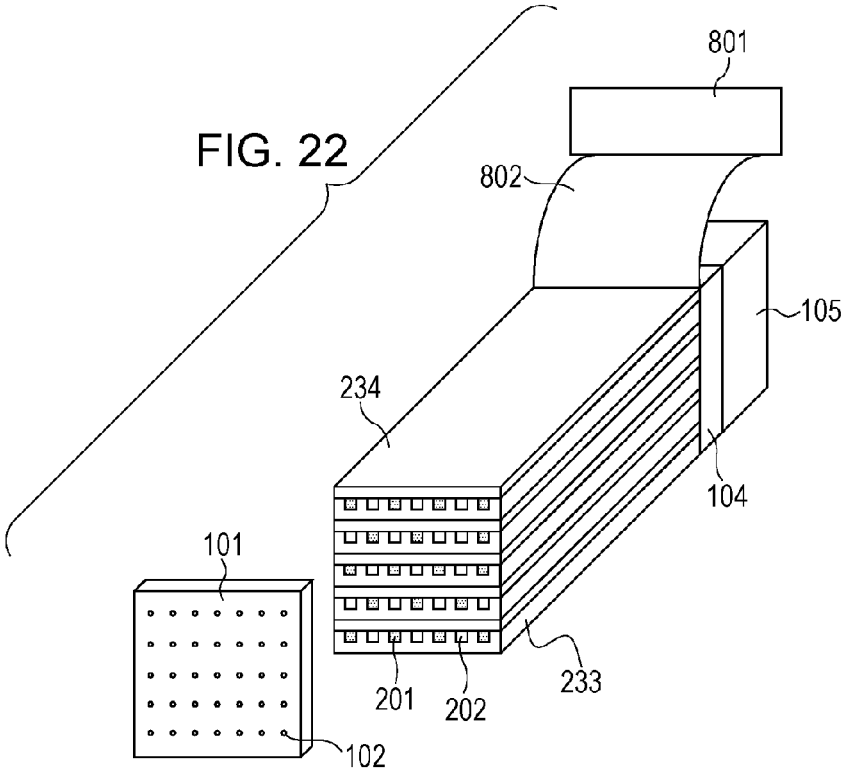
FIG. 22 is an exploded perspective view illustrating a modification of the liquid ejection head of the sixth embodiment.

FIG. 22 is an exploded perspective view illustrating a modification of the liquid ejection head of the present embodiment. In the liquid ejection head illustrated in FIG. 22, a driving circuit of the pressure chamber 201 is provided in a circuit board 801. The circuit board 801 is electrically connected to the first electrode 205 and the second electrode 206 via a flexible printed circuit (FPC) 802. Such a driving configuration is applicable not only to the present embodiment but other embodiments.

In the fourth to sixth embodiments described above, each pressure chamber 201 is shrink-deformed by the driving method described in the first to third embodiments. Therefore, also in the liquid ejection head of the fourth to sixth embodiments, the driving timing of each pressure chamber 201 is controlled so that adjoining pressure chambers are not driven sequentially as in the liquid ejection head of the first to third embodiments. Therefore, a situation in which other vibration is superimposed on residual vibration may be avoided and it becomes possible to detect abnormality in the ejection state with high accuracy.

According to the present invention, the piezoelectric portion of each pressure chamber is driven such that adjoining pressure chambers do not shrink-deform sequentially. Therefore, making it difficult to superimpose other vibration on residual vibration produced in the pressure chamber which includes a piezoelectric portion is possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-191711, filed Sep. 17, 2013, which is hereby incorporated by reference herein in its entirety.

What is claimed is:

1. A liquid ejection head, comprising:

a plurality of ejection ports from which a liquid is ejected;

a plurality of pressure chambers which communicate with the plurality of ejection ports and are constituted by piezoelectric portions that eject a liquid from the ejection ports by shrink-deforming;

a control unit configured to drive the piezoelectric portions so that the pressure chambers shrink-deform; and a first switch for switching, in accordance with the control of the control unit, from an ON state in which a driving state of the piezoelectric portions are maintained to an OFF state in which the driving state is released, and a second switch for switching, when the first switch is switched from the ON state to the OFF state, a connection destination of the piezoelectric portion from the first switch to an abnormality detection unit, wherein the control unit controls driving timing of the piezoelectric portions such that, after any of the plurality of pressure chambers is made to shrink-deform, a pressure chamber disposed not to adjoin the shrink-deformed pressure chamber is made to shrink-deform.

2. The liquid ejection head according to claim 1, wherein the abnormality detection unit is configured to detect abnormality in an ejection state of the liquid by detecting vibration produced in the piezoelectric portions when the pressure chambers recover a state before the shrinkage deformation takes place.

3. The liquid ejection head according to claim 1, further comprising a driving detection unit configured to detect the shrinkage deformation of each of the pressure chambers in accordance with the ON state of the first switch, wherein the driving detection unit permits the switching action of the second switch in a case in which the driving detection unit detects that the pressure chambers disposed not to adjoin each other are shrink-deforming at the same time.

4. The liquid ejection head according to claim 1, further comprising a driven number measurement unit configured to measure the number of pressure chambers that are shrink-deforming at the same time in accordance with the ON state of the first switch, wherein the driven number measurement unit permits the switching action of the second switch in a case in which the number of pressure chambers becomes equal to or less than a threshold value.

5. The liquid ejection head according to claim 4, wherein the threshold value is 1.

6. The liquid ejection head according to claim 1, wherein the plurality of pressure chambers are arranged in a grid pattern, and shrink-deformed pressure chambers are arranged at positions not to adjoin each other in two directions of the grid pattern formed by the plurality of pressure chambers.

* * * * *